US007637108B1

(12) United States Patent
Langson

(10) Patent No.: US 7,637,108 B1
(45) Date of Patent: Dec. 29, 2009

(54) POWER COMPOUNDER

(75) Inventor: Richard K. Langson, Carson City, NV (US)

(73) Assignee: Electratherm, Inc., Carson City, NV (US)

( * ) Notice: Subject to any disclaimer, the term of this patent is extended or adjusted under 35 U.S.C. 154(b) by 285 days.

(21) Appl. No.: 11/656,309

(22) Filed: Jan. 19, 2007

Related U.S. Application Data

(60) Provisional application No. 60/760,633, filed on Jan. 19, 2006.

(51) Int. Cl.
*F02G 3/00* (2006.01)

(52) U.S. Cl. ..... 60/616; 60/618; 60/624

(58) Field of Classification Search ..... 60/614, 60/616, 618, 624
See application file for complete search history.

(56) References Cited

U.S. PATENT DOCUMENTS

| | | | | |
|---|---|---|---|---|
| 1,795,886 | A | 3/1931 | Prugh | |
| 4,201,058 | A * | 5/1980 | Vaughan | 60/618 |
| 4,785,631 | A * | 11/1988 | Striebich | 60/618 |
| 5,056,315 | A * | 10/1991 | Jenkins | 60/614 |
| 5,327,987 | A * | 7/1994 | Abdelmalek | 180/65.2 |
| 6,205,792 | B1 | 3/2001 | Anderson | |
| 6,401,463 | B1 | 6/2002 | Dukhan et al. | |
| 6,571,548 | B1 | 6/2003 | Bronicki et al. | |
| 6,718,955 | B1 * | 4/2004 | Knight | 123/559.1 |
| 6,880,344 | B2 | 4/2005 | Radcliff et al. | |
| 6,962,056 | B2 | 11/2005 | Brasz et al. | |
| 7,104,061 | B2 * | 9/2006 | Hisanaga et al. | 60/597 |
| 2004/0088985 | A1 | 5/2004 | Brasz et al. | |
| 2005/0247059 | A1 | 11/2005 | Cogswell et al. | |

OTHER PUBLICATIONS

"BMW Unveils the Turbosteamer Concept", http://www.gizmag.com/go/4936, May 24, 2006.

Leibowitz, H., Smith, I.K., and Stosie, N., Sost Effective Small Scale ORC Systems for Power Recovery from Low Grade Heat Sources, 2006 ASME International Mechanical Engineering Congress and Exposition, Chicago, Illinois, USA, Nov. 5-10, 2006.

* cited by examiner

*Primary Examiner*—Hoang M Nguyen
(74) *Attorney, Agent, or Firm*—Steven M. McHugh; Nicole E. Corres Gathy

(57) ABSTRACT

A power compounder is disclosed. The power compounder comprises a working fluid configured to receive thermal energy from waste heat of a prime mover, a working fluid collector, an evaporator configured to transfer waste heat to a working fluid producing a phase change to vapor (or gas) in the working fluid, a double screw expander configured to receive the working fluid for creating rotational mechanical energy, and a condenser configured to produce another phase change in the working fluid to liquid. The double screw expander transfers the rotational mechanical energy via a shaft to the prime mover.

18 Claims, 8 Drawing Sheets

POWER COMPOUNDER

PRIORITY CLAIM

This Application claims priority to Provisional Patent Application No. 60/760,633, entitled "Power Compounder" filed on Jan. 19, 2006.

BACKGROUND

The conversion of fuels into electricity has long been the focus of engineers. The supply of the fuel to a generation site, as well as the reliability and cost of the supply, is factored into the engineering decision process.

The thrust of waste heat recovery technology is to make use of thermal energy normally discarded from a primary power conversion process. In many prior art devices, the discarded thermal energy (i.e., waste heat) is harnessed to drive additional thermo-fluid processes that can yield additional energy (i.e., electricity).

Referring to prior art FIG. 1, the prior art waste heat recovery system directs a supply of waste heat measured at temperatures between 300° F. to 800° F. from a heat source to an evaporator (see numeral 1). The waste heat is transferred to a working fluid in the evaporator. The working fluid is evaporated; changes from a liquid to a vapor, in the evaporator and is expanded through a turbine (see numeral 2). The expansion of the working fluid through the turbine drives the turbine. The turbine, in turn, drives an electric generator coupled to the turbine. The generator produces electrical power. The working fluid flows to a condenser and changes phase from vapor to a liquid (see numeral 3). The liquid working fluid is then pumped back to the evaporator and begins the cycle again (see numeral 4). The above described system employs a closed-loop Organic Rankin Cycle to produce electricity from a thermal energy source, such as waste heat. This example illustrates that the prior art waste heat recovery systems were utilized to produce electricity.

Using the above concept of a reverse refrigeration cycle, or Organic Rankin Cycle (ORC), the waste heat of an engine can be converted to produce a more efficient engine; not electricity. However, the above example relies on turbines to operate the generator. Turbines operate at a greater rotational speed than conventional engines and require extensive, complex machinery in order to try and capture the thermal energy for reuse as mechanical energy.

What is needed in the art is an Organic Rankin Cycle system to convert waste heat from an engine into useful power for the engine that is simple, reliable and cost effective.

SUMMARY

The following presents a simplified summary of the present disclosure in order to provide a basic understanding of some aspects of the present disclosure. This summary is not an extensive overview of the present disclosure. It is not intended to identify key or critical elements of the present disclosure or to delineate the scope of the present disclosure. Its sole purpose is to present some concepts of the present disclosure in a simplified form as a prelude to the more detailed description that is presented herein.

A power compounder is disclosed. The power compounder comprises a working fluid configured to receive thermal energy from waste heat of a prime mover, a working fluid collector, an evaporator configured to transfer waste heat to a working fluid producing a phase change to vapor (or gas) in the working fluid, a double screw expander configured to receive the working fluid for creating rotational mechanical energy, and a condenser configured to produce another phase change in the working fluid to liquid. The double screw expander transfers the rotational mechanical energy via a shaft to the prime mover.

The disclosure is also directed toward a power compounder system. The power compounder system comprises a prime mover producing waste heat and a power compounder coupled to the prime mover. The power compounder comprises a working fluid configured to receive thermal energy from the waste heat from the prime mover; a working fluid collector configured to hold the working fluid as a liquid working fluid; an evaporator fluidly coupled to the working fluid collector, such that the evaporator is configured to transfer the waste heat to the working fluid to change the working fluid from a liquid working fluid to a vapor working fluid; a double screw expander fluidly coupled to the evaporator, such that the expander is configured to receive the vapor working fluid to create rotational mechanical energy from expansion of the vapor working fluid through the double screw expander, the double screw expander transfers the rotational mechanical energy via a shaft to the prime mover; and a condenser fluidly coupled to the double screw expander, such that the condenser is configured to receive the vapor working fluid and change the vapor working fluid to the liquid working fluid, the condenser is fluidly coupled to the working fluid collector.

The disclosure is also directed toward a method of using a power compounder system. The method comprises directing waste heat produced in a prime mover to a power compounder; transferring thermal energy from the waste heat to a liquid working fluid; transforming the liquid working fluid to a vapor working fluid in an evaporator; directing the vapor working fluid through a double screw expander fluidly coupled to the evaporator; creating rotational mechanical energy in the double screw expander when the vapor working fluid flows through the double screw expander; transferring the rotational mechanical energy via a shaft of the double screw expander to the prime mover; and directing the vapor working fluid to a condenser for transforming to the liquid working fluid, the condenser is fluidly coupled to the expander.

BRIEF DESCRIPTION OF THE FIGURES

Referring now to the figures, wherein like elements are numbered alike.

DETAILED DESCRIPTION

Persons of ordinary skill in the art will realize that the following disclosure is illustrative only and not in any way limiting. Other embodiments of the disclosure will readily suggest themselves to such skilled persons having the benefit of this disclosure.

The present disclosure is a power compounder system that converts waste heat thermal energy from a source (or prime mover or engine) into rotational mechanical energy. Power compounding is the process of directly attaching an expander (or a compressor configured to act as an expander) to a shaft of a prime mover. For example, in a typical combustion engine, the thermal energy is normally discarded via jacket water heat through a radiator, engine exhaust out a stack, oil cooler, or any other conventional means. In the present disclosure, the normally discarded waste heat is recovered from the engine and harnessed. The waste heat is harnessed using an Organic Rankin Cycle (ORC) power compounder having an expander (i.e., double or twin screw). The waste heat is harnessed by conversion to rotational mechanical energy which is redirected back to the engine, increasing the engine's net power output by as much as about 10% additional horsepower. This additional horsepower is achieved without using additional fuel or producing additional emissions.

Figure 1:
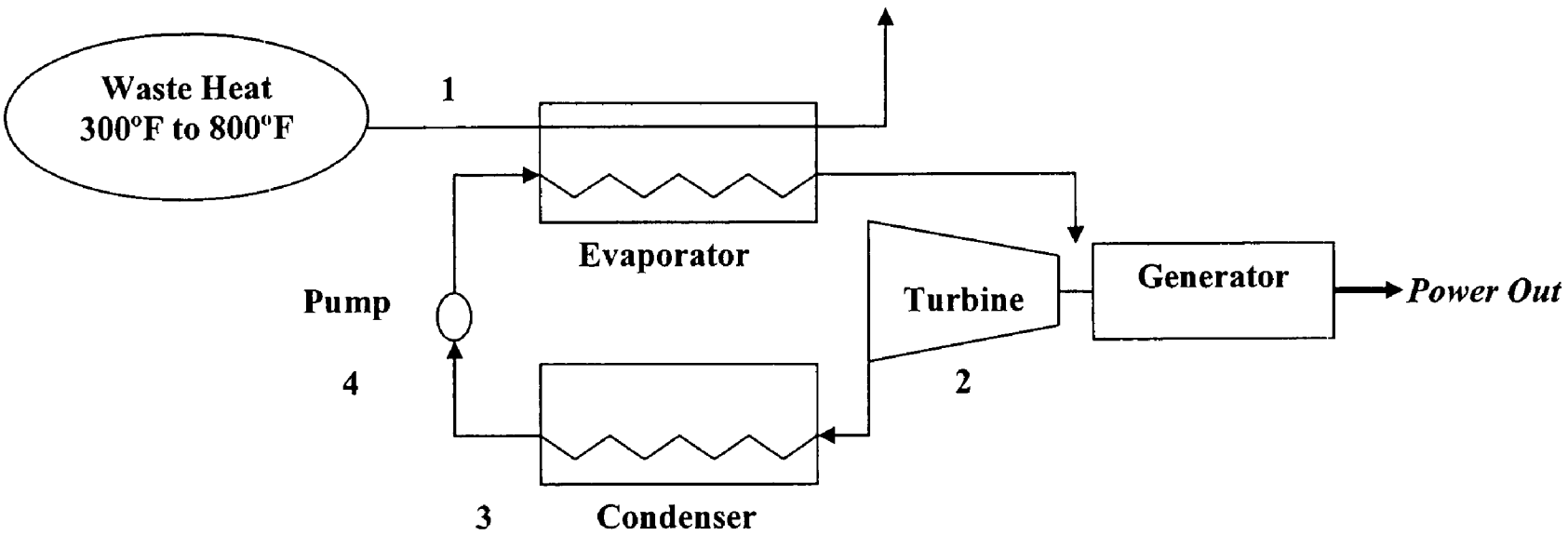
FIG. 1 PRIOR ART
FIG. 1 is a diagram of a prior art waste heat recovery system.
Figure 2:
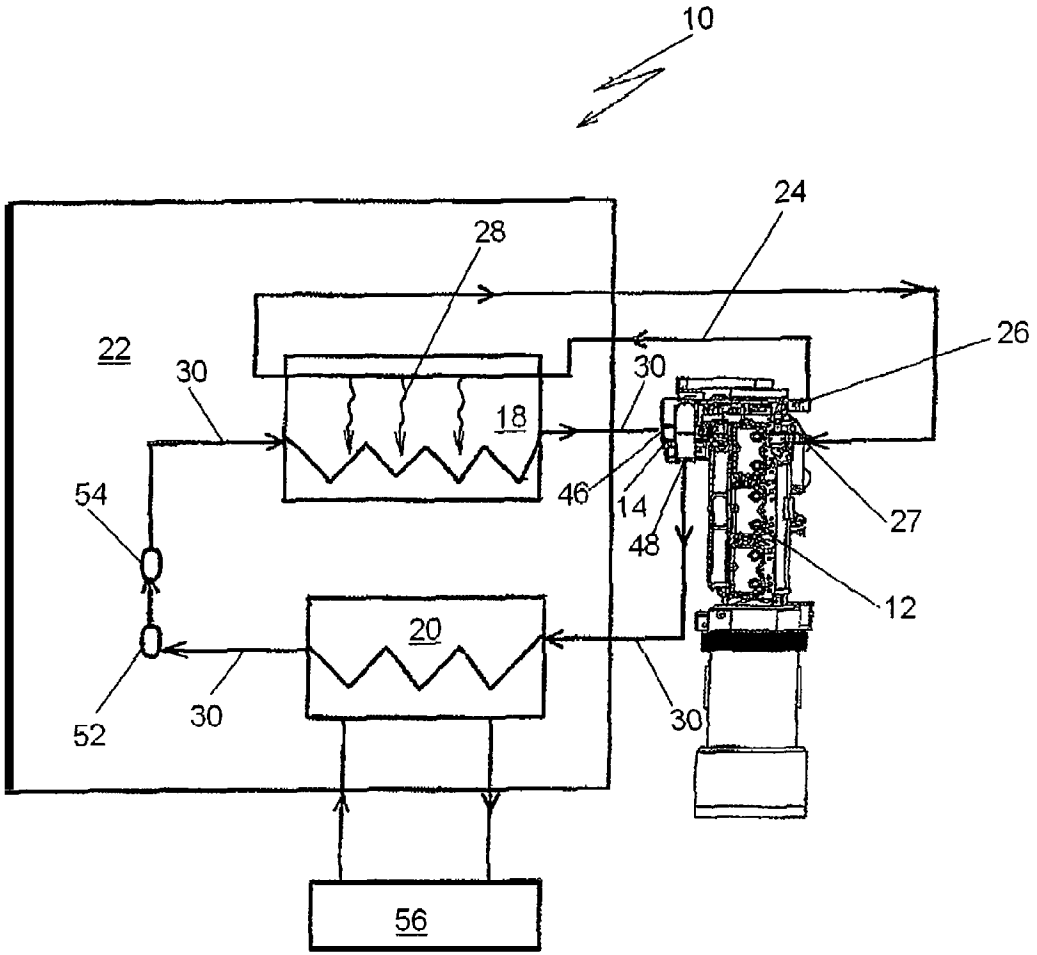
FIG. 2 is a schematic of an exemplary power compounder system.
Figure 3:
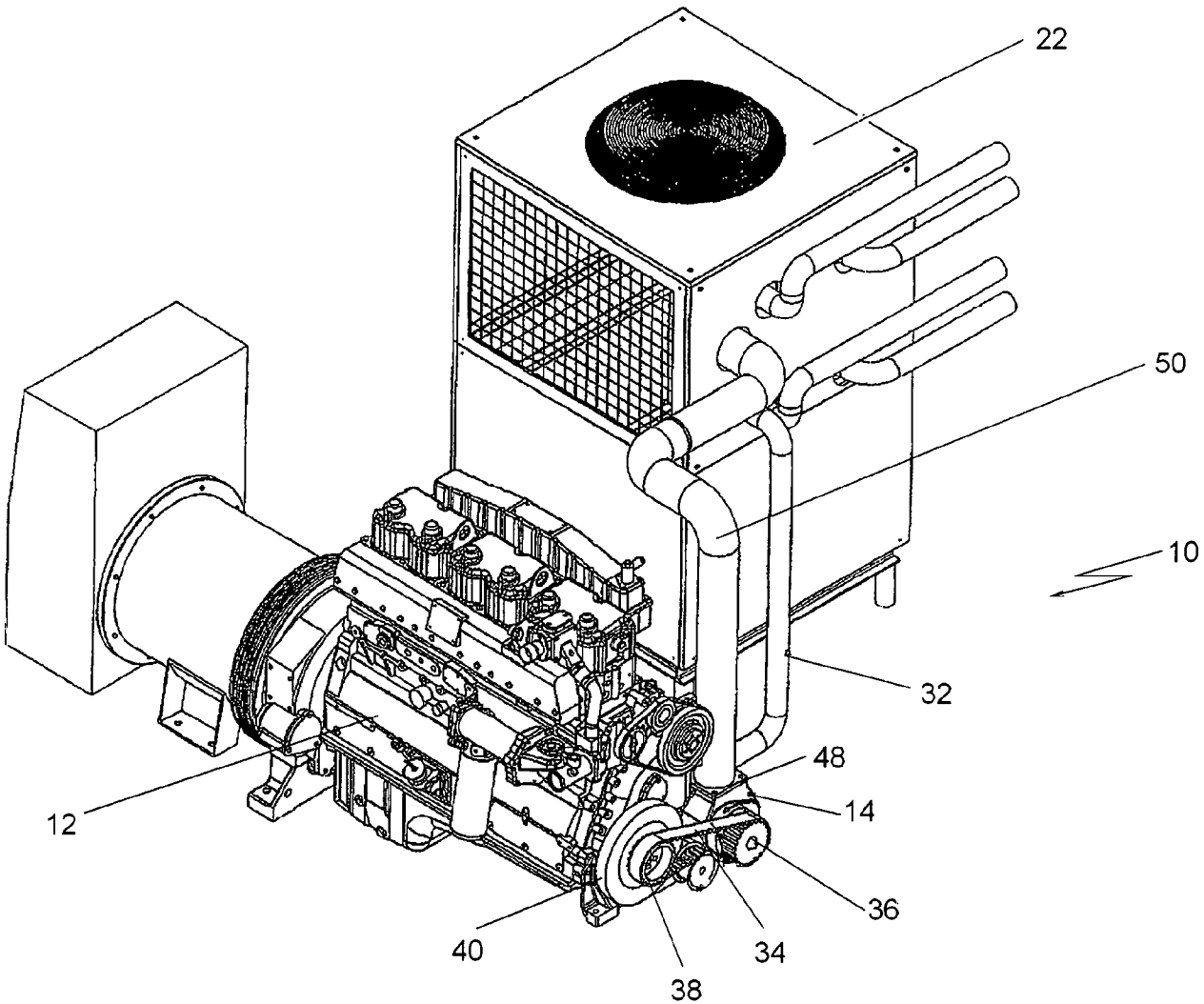
FIG. 3 is a side view of an exemplary power compounder system.
Figure 4:
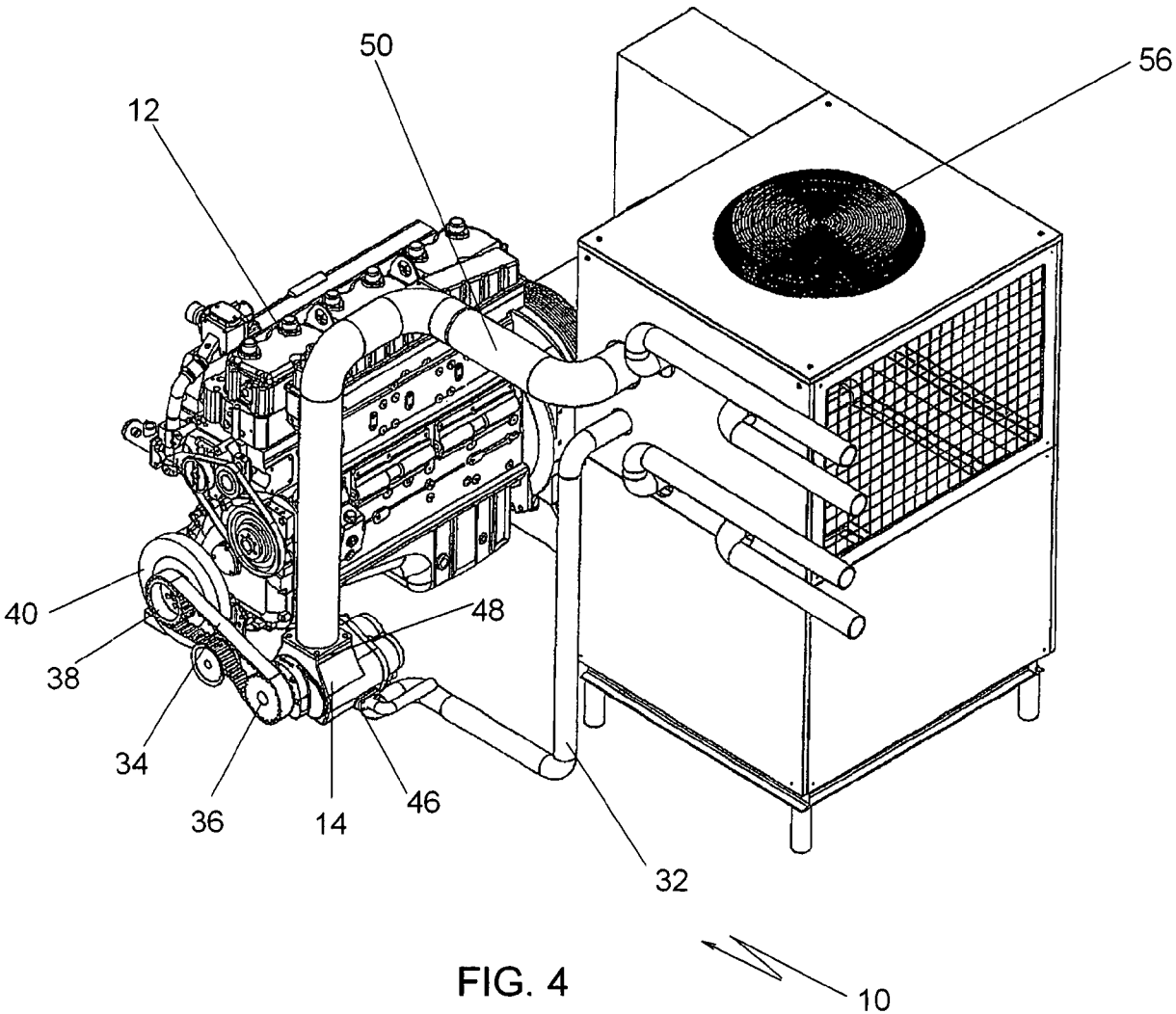
FIG. 4 is another side view of the exemplary power compounder system of FIG. 3.
Figure 5:
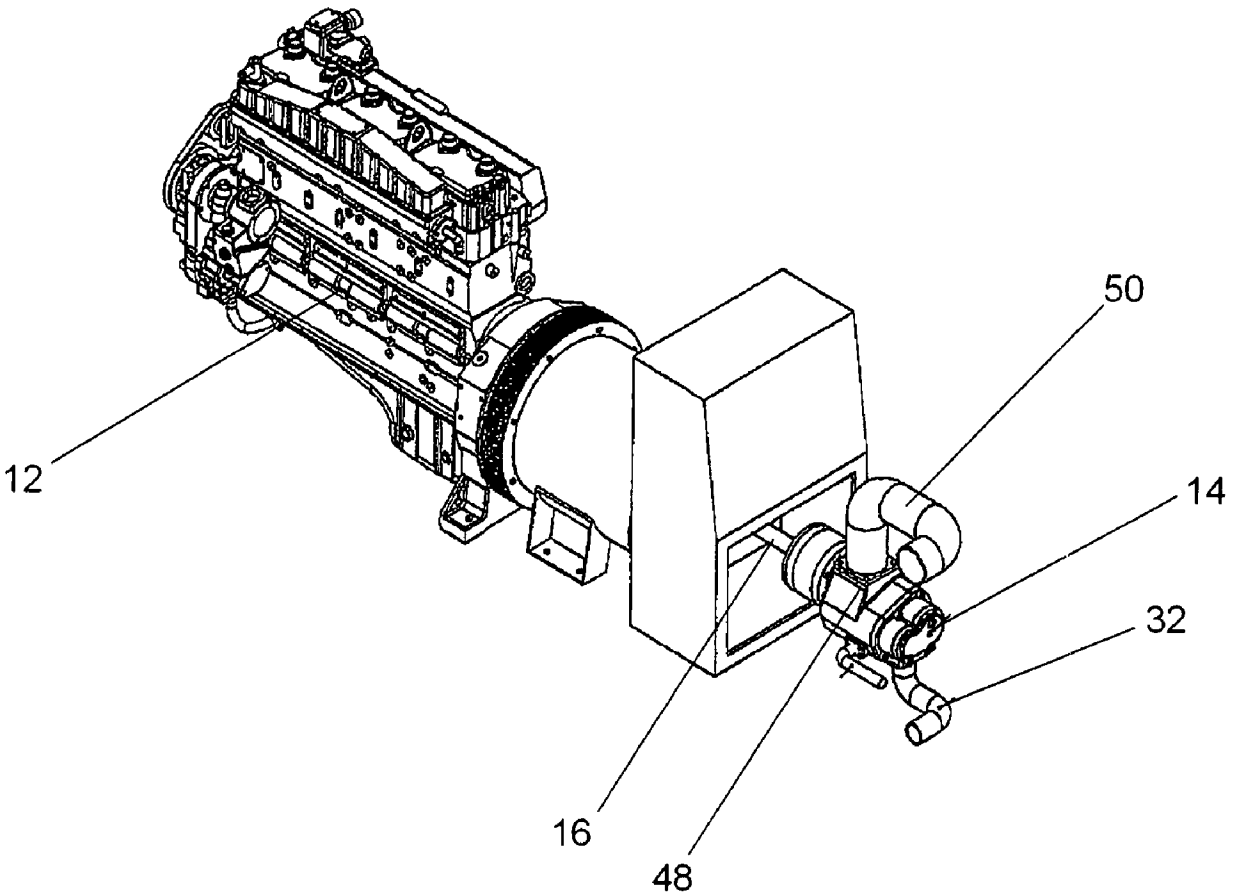
FIG. 5 is a side view of another exemplary power compounder system.

FIG. 2 is a schematic of an embodiment of the present disclosure. FIGS. 3, 4, and 5 illustrate exemplary embodiments of the power compounder 10 system coupled to a prime mover (e.g., an engine) 12. The power compounder 10 has an expander 14 that is coupled to the prime mover 12 via a shaft 16. In one embodiment illustrated in FIGS. 3 and 4, elements (i.e., the evaporator 18, the condenser 20, and the like) of the power compounder 10 are contained within a system cabinet 22.

Although a combustion engine is illustrated in FIGS. 3, 4, and 5 as the prime mover 12, any machine that utilizes mechanical energy can be utilized, including but not limited to, pumps, external combustion engines, internal combustion engines, turbines, compressors, and the like.

Referring again to FIG. 2, as the prime mover 12 is operated, waste heat (illustrated as arrow 24) is discarded from the prime mover 12. The waste heat 24 can be transferred via any known means compatible to the prime mover, including but not limited to, engine lube oil, coolant, exhaust, water jacket, and the like. Waste heat is a term that generally covers various sources of thermal energy in a transfer medium at temperatures as low as about 140° F. (such as a fluid, a hot gas, hot oil, hot water, steam, and the like). The waste heat can be supplied from a wide variety of sources including but not limited to: internal combustion engines, gas turbines, gas flares in landfills, industrial manufacturing processes that continuously produce thermal energy, incinerators, boilers, water heaters, geothermal wells, methane, bio-gas sources, and the like.

In the preferred embodiment, waste heat 24 is directed from the prime mover 12 to the power compounder 10 via an outlet 26. The thermal energy 28 is transferred to a working fluid (illustrated as arrow 30) in the evaporator 18. The waste heat 24 medium is returned to the prime mover 12 via inlet 27. The working fluid 30 can be any known working fluid, including but not limited to, water, refrigerants, light hydrocarbons, and the like. The working fluid must be compatible with the power compounder system. The preferred working fluids are refrigerants, including but not limited to, R-124, R-134a, R-245fa, and the like. The working fluid 30 is transformed in an evaporator 18 located in the system cabinet 22. The evaporator 18 transfers the thermal energy 28 from the waste heat 24 from the prime mover 12 to the working fluid 30.

The evaporator 18 exchanges the thermal energy 28 from the waste heat 24 to the working fluid 30. The evaporator 18 can be any variety of heat exchangers and fashioned to operate with the waste heat, including, but not limited to, plate, tube and shell, tube and fin, and the like. For example, if the waste heat is in the form of an internal combustion engine exhaust, the heat exchanger can comprise a gas heat exchanger. Intermediate heat exchangers (not shown) can be employed to separate the waste heat medium from the evaporator.

The working fluid 30 is heated in the evaporator 18 and changes phase from a liquid phase to a vapor (or gas) phase. The working fluid 30 having gained the thermal energy 28 and having reached a higher energy state (i.e., vapor or gas phase), flows from the evaporator 18 through piping 32 to the expander 14, and expands through the expander 14 transferring the higher thermal energy into mechanical energy. The working fluid 30 is compressed (i.e., under pressure) having potential energy as it enters the expander 14 through the inlet 46. After proceeding through the expander 14, the working fluid exits through the outlet 48 having transferred the potential energy to the shaft 16 creating kinetic energy.

In a preferred embodiment, the shaft 16 of the expander 14 can be coupled directly to a drive shaft of the prime mover 12 through a generator (see FIG. 5) or coupled with belts 34 and/or gears or pulleys 36, 38 to the crankshaft 40 (or drive shaft or any other appropriate location) of the prime mover 12 (see FIGS. 3 and 4). The shaft 16 of the expander 14 can also be connected via a pulley and idler arrangement (or directly in the case of the engine's power take-off (PTO) shaft) (not shown) to the output shaft of the prime mover 12 itself.

Figure 6:
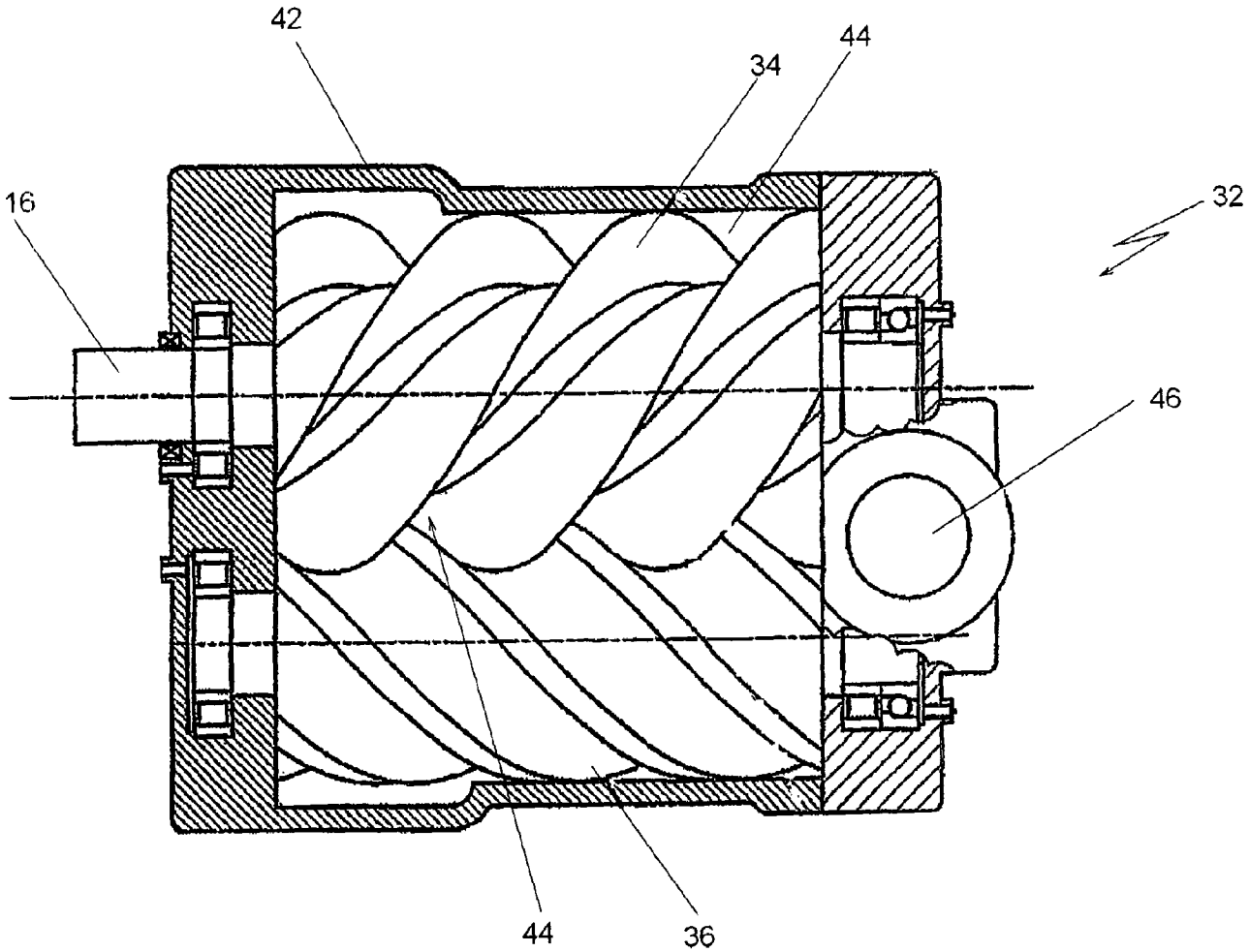
FIG. 6 is a bottom view of a double screw expander.
Figure 7:
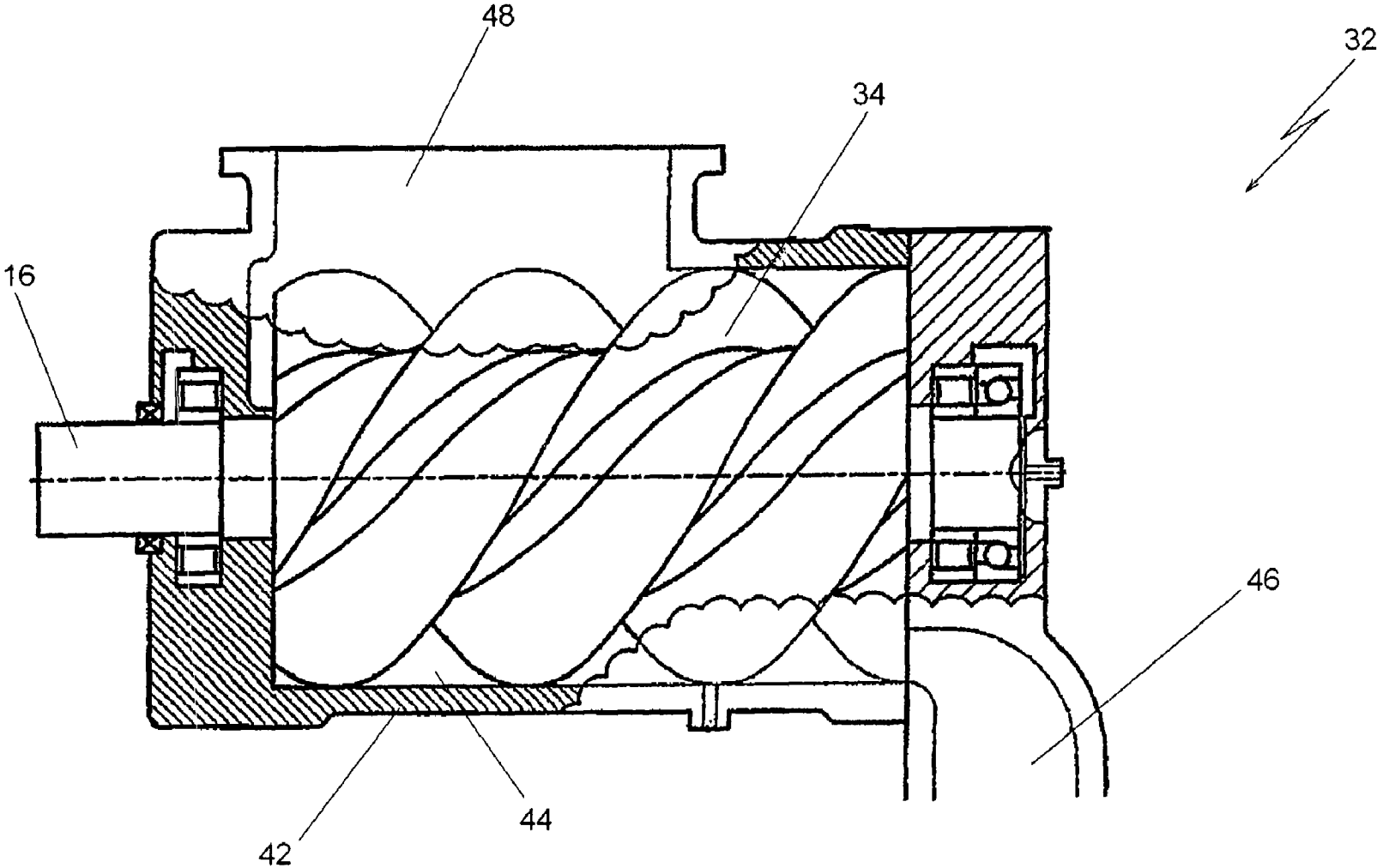
FIG. 7 is a front view of a double screw expander.

The preferred expander 14 is a double (or twin) screw expander 32. FIG. 6 illustrates a bottom view of an interior of a double screw expander 32. The double screw expander 32 uses the working fluid 30 to create mechanical rotation. The working fluid 30 expands through the double screw expander 32 causing the two rotors (or screws) 34, 36 to turn (or rotate), thus creating mechanical energy. The mechanical energy is transferred into shaft power. Referring now to FIG. 7, a front view of a double screw expander 32 is illustrated. The working fluid 30 flows into the double screw expander 32 via inlet 46 and exits via outlet 48. As the working fluid 30 expands through the double screw expander 32, mechanical energy is created. The mechanical energy is then transferred into shaft power.

A double screw expander 32 has two meshing helical rotors 34, 36 that are contained within a casing 42, which surrounds the rotors 34, 36 with a very small clearance. The spaces between the rotors 34, 36 and the casing 42 create working chambers 44. The working fluid 30 enters the double screw expander 32 through inlet 46 and expands through the working chambers 44 in the direction of rotation until it is expelled through outlet 48. Power is transferred between the working fluid 30 and the shaft 16 from torque created by the forces on the rotor 34, 36 surfaces due to the pressure of the working fluid 30, which changes with the volume of the working fluid 30.

Figure 8:
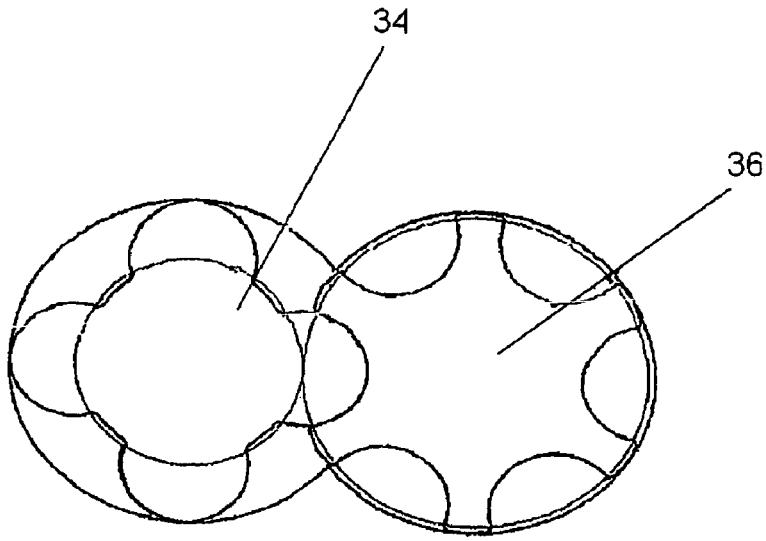
FIG. 8 is a front view of a profile of the rotors of a double screw expander.
Figure 9:
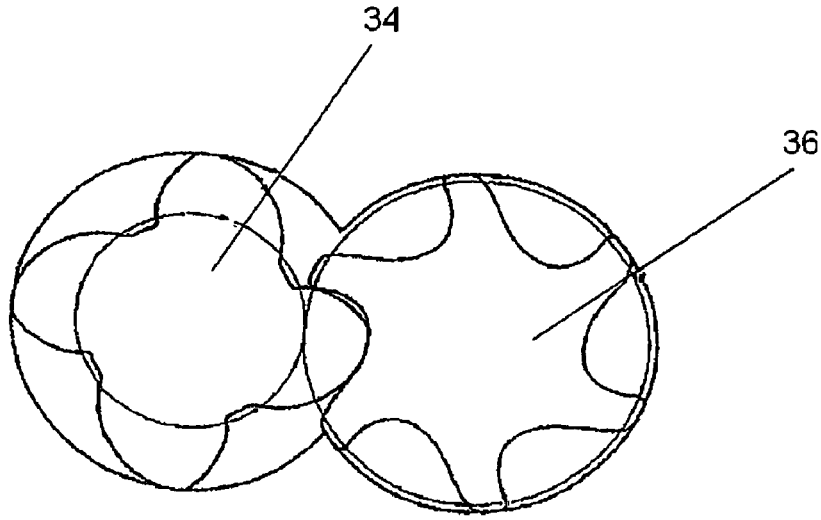
FIG. 9 is a front view of another profile of the rotors of a double screw expander.

In order to achieve a high flow rate and efficiency, the profile of the rotor 34, 36 is important. A conventional profile is illustrated in FIG. 8, in which a symmetric profile of the rotors 34, 36 is provided. The preferred embodiment for the double screw expander 32 profile is illustrated in FIG. 9. A rack generated "N" profile utilized as a rotor profile increases the rotational speed of the double screw expander 32.

Referring again to FIGS. 2 and 3, upon exiting the expander 14 through the outlet 48 to piping 50, the working fluid 30 is now a low pressure gas (or vapor) that flows to a condenser 20, where the working fluid 30 undergoes a phase change again from vapor (or gas) to liquid. In a preferred embodiment, the condenser 20 comprises at least one of shells, tubes, and fins. The use of a refrigerant, cooling water, or cooling air can enhance the cooling capabilities of the condenser 20.

The liquid working fluid 30 then flows by gravity to a receiver tank 52 configured to contain the liquid working fluid 30 (i.e., preferably a tank that is about 30 gallons to about 100 gallons). An ORC feed pump 54 controls the flow rate of the working fluid 30 to the evaporator 18. A cooling medium, such as liquid or air, can be utilized to further condense the gaseous working fluid into a liquid working fluid. As illustrated in FIG. 2, a cooling tower 56 (or cooling fan, and the like) can be utilized to supply the cooling medium.

The admission of wet vapor to the expander 14 can be used to improve the performance of the power compounder 10 by simplifying and reducing the cost of expander 14 lubrication by dissolving or otherwise dispersing about 5% oil by mass in the working fluid 30.

The above system is a closed loop Organic Rankin Cycle in order to produce rotational mechanical power from thermal energy sources. This use of a power compounder results in an increase of net power to the host prime mover of about 5% to about 15% net power, with about 10% net power preferred.

The present disclosure includes a simple and reliable cost efficient ORC power compounder using a double screw expander to produce rotational power. This rotational mechanical energy can be used to increase power output by as much as about 10% net increase to many prime movers, such as engines, pumps and mechanical power outputs for hundred of applications. Since the rotational speed of the expander of the power compounder is operated at similar rotational speeds as the prime mover, there is no need for any high speed reduction gear reducer or electronics. The rotational mechanical energy of the expander can be synchronized to the rotation of the prime mover.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings without departing from the essential scope thereof. Therefore, it is intended that the disclosure not be limited to the particular embodiment disclosed as the best mode contemplated for carrying out this disclosure.

What is claimed is:

1. A power compounder system comprising:

a prime mover producing waste heat; and a power compounder coupled to said prime mover, said power compounder comprising:

a working fluid configured to receive thermal energy from said waste heat from said prime mover;

a working fluid collector configured to hold said working fluid as a liquid working fluid;

an evaporator fluidly coupled to said working fluid collector, said evaporator configured to transfer said waste heat to said working fluid to change said working fluid from said liquid working fluid to a vapor working fluid;

a feed pump configured to cause said working fluid to flow between said working fluid collector and said evaporator;

a double screw expander fluidly coupled to said evaporator, said expander configured to receive said vapor working fluid to create rotational mechanical energy from expansion of said vapor working fluid through said double screw expander, said double screw expander transfers said rotational mechanical energy via a shaft to said prime mover, wherein said double screw expander is further coupled to said prime mover via a power take-off shaft; and a condenser fluidly coupled to said double screw expander, said condenser configured to receive said vapor working fluid and change said vapor working fluid to said liquid working fluid, said condenser is fluidly coupled to said working fluid collector.

2. The power compounder system of claim 1, wherein said prime mover has an increase of net power of about 10% from addition of said rotational mechanical energy.

3. The power compounder system of claim 1, wherein said working fluid flows by force of gravity from said condenser to said working fluid collector.

4. The power compounder system of claim 1, wherein said feed pump is configured to control a flow rate of said working fluid from said working fluid collector to said evaporator.

5. The power compounder system of claim 1, further comprising:

a pump configured to supply said working fluid to said evaporator.

6. The power compounder system of claim 1, wherein said prime mover is selected from the group consisting of engines, pumps, external combustion engines, internal combustion engines, turbines, and compressors.

7. The power compounder system of claim 1, wherein said rotational mechanical energy is synchronized to a rotational mechanical energy of said prime mover.

8. The power compounder system of claim 1, further comprising:

a timing belt coupled to a pulley on said double screw expander and to a pulley on said prime mover; wherein a combination of said timing belt and said pulleys transfers said rotational mechanical energy to said prime mover.

9. The power compounder system of claim 1, further comprising:

a system cabinet comprising said working fluid collector, said evaporator, said condenser and a cooling tower coupled to said condenser.

10. A method of using a power compounder system, comprising:

directing waste heat produced in a prime mover to a power compounder;

transferring thermal energy from said waste heat to a liquid working fluid;

transforming said liquid working fluid to a vapor working fluid in an evaporator;

directing said vapor working fluid through a double screw expander fluidly coupled to said evaporator, wherein said double screw expander is further coupled to said prime mover via a power take-off shaft;

creating rotational mechanical energy in said double screw expander when said vapor working fluid flows through said double screw expander;

transferring said rotational mechanical energy via a shaft of said double screw expander to said prime mover; and directing said vapor working fluid to a condenser for transforming to said liquid working fluid, said condenser fluidly coupled to said expander.

11. The method of claim 10, further comprising:

increasing a net power of said prime mover by about 10%.

12. The method of claim 10, further comprising:

flowing said working fluid by force of gravity from said condenser to a working fluid collector fluidly coupled to said evaporator; and controlling a flow rate of said working fluid from said working fluid collector to said evaporator using a feed pump.

13. The method of claim 10, further comprising:

supplying said working fluid to said evaporator using a pump.

14. The method of claim 10, wherein said prime mover is selected from the group consisting of engines, pumps, external combustion engines, internal combustion engines, turbines, and compressors.

15. The method of claim 10, further comprising:

synchronizing said rotational mechanical energy of said power compounder to a rotational mechanical energy of said prime mover.

16. The method of claim 10, further comprising:

coupling a timing belt to a pulley on said double screw expander and to a pulley on said prime mover, wherein a combination of said timing belt and said pulleys transfers said rotational mechanical energy to said prime mover.

17. The method of claim 10, further comprising:

coupling a timing belt to a gear on said double screw expander and to a gear on said prime mover, wherein a combination of said timing belt and said gears transfers said rotational mechanical energy to said prime mover.

18. The method of claim 10, further comprising:

positioning a working fluid collector, said evaporator, said condenser and a cooling tower in a system cabinet, said cooling tower coupled to said condenser.

* * * * *